US010612559B2

(12) United States Patent
Kou et al.

(10) Patent No.: US 10,612,559 B2
(45) Date of Patent: Apr. 7, 2020

(54) TWO-STAGE BLADE ADJUSTING DEVICE FOR COUNTER-ROTATING AXIAL FLOW FAN

(71) Applicant: TAIYUAN UNIVERSITY OF TECHNOLOGY, Taiyuan (CN)

(72) Inventors: Ziming Kou, Taiyuan (CN); Guijun Gao, Taiyuan (CN); Jing Zhang, Taiyuan (CN); Juan Wu, Taiyuan (CN); Jing Liu, Taiyuan (CN); Xin Xing, Taiyuan (CN)

(73) Assignee: TAIYUAN UNIVERSITY OF TECHNOLOGY, Taiyuan (CN)

( * ) Notice: Subject to any disclaimer, the term of this patent is extended or adjusted under 35 U.S.C. 154(b) by 0 days.

(21) Appl. No.: 16/081,005

(22) PCT Filed: Nov. 10, 2016

(86) PCT No.: PCT/CN2016/105319

§ 371 (c)(1),
(2) Date: Aug. 29, 2018

(87) PCT Pub. No.: WO2017/148177

PCT Pub. Date: Sep. 8, 2017

(65) Prior Publication Data

US 2019/0040872 A1 Feb. 7, 2019

(30) Foreign Application Priority Data

Mar. 4, 2016 (CN) ..... 2016 1 0122964

(51) Int. Cl.

| | |
|---|---|
| ***F04D 29/36*** | (2006.01) |
| ***F04D 19/00*** | (2006.01) |
| ***F04D 19/02*** | (2006.01) |

(52) U.S. Cl.

CPC ..... *F04D 29/36* (2013.01); *F04D 19/002* (2013.01); *F04D 19/007* (2013.01); *F04D 19/024* (2013.01)

(58) Field of Classification Search

CPC ..... F04D 29/36; F04D 19/024

See application file for complete search history.

(56) References Cited

FOREIGN PATENT DOCUMENTS

| | | |
|---|---|---|
| CN | 2209231 | 10/1995 |
| CN | 2937576 | 8/2007 |
| CN | 201433935 | 3/2010 |
| CN | 201865932 | 6/2011 |

(Continued)

*Primary Examiner* — Kenneth Bomberg
*Assistant Examiner* — John S Hunter, Jr.
(74) *Attorney, Agent, or Firm* — Vedder Price P.C.

(57) ABSTRACT

The present disclosure provides a two-stage blade adjusting device for a counter-rotating axial flow fan. A blade adjusting operation shaft is adjusted to drive a pair of bevel gears to transfer power to a threaded pair coaxial with a transmission shaft, the threaded pair transforms rotary motion of the bevel gears into linear motion to push thrust discs in hubs, the blade installation angle of a first impeller is thus adjusted, and a spacer bush transfers the power to adjust the blade installation angle of a second impeller, so that synchronous adjustment of two-stage blade installation angles is realized. The device is simple and compact in structure and low in manufacturing and maintenance cost, and can be widely applied to large, medium and small counter-rotating axial flow fans.

5 Claims, 3 Drawing Sheets

(56) References Cited

FOREIGN PATENT DOCUMENTS

| | | | |
|---|---|---|---|
| CN | 202194861 | U | 4/2012 |
| CN | 202545314 | U | 11/2012 |
| CN | 202560636 | U | 11/2012 |
| CN | 202597240 | U | 12/2012 |
| CN | 103727062 | A | 4/2014 |
| CN | 204386932 | U | 6/2015 |
| CN | 105673560 | A | 6/2016 |
| EP | 1319814 | | 6/2003 |
| EP | 1319814 | A2 | 6/2003 |
| EP | 1961919 | | 8/2008 |
| EP | 1961919 | A2 | 8/2008 |
| JP | S54112006 | | 9/1979 |
| SU | 1054578 | | 11/1983 |
| WO | 2014139560 | A1 | 9/2014 |
| WO | WO-2018129769 | A1 * | 7/2018 |

* cited by examiner

TWO-STAGE BLADE ADJUSTING DEVICE FOR COUNTER-ROTATING AXIAL FLOW FAN

TECHNICAL FIELD

The present disclosure relates to a blade adjusting device for a counter-rotating axial flow fan, and particularly, to a mechanically driven type two-stage blade adjusting device for a counter-rotating axial flow fan.

BACKGROUND

A desirable ventilation system should be simple in structure, and ventilation equipment can be adjusted according to actual conditions for safety production. The quality of the ventilation equipment has a significant impact on the ventilation effect. The existing moving blade adjustable axial flow fan is usually driven by a hydraulic system to adjust the installation angles of blades. The hydraulic system generally includes a pump, a pipeline, a servo valve, a servo cylinder and the like, wherein considerable parts of components need to be specially made, so that the overall manufacturing process of the system is complex and the maintenance cost is high. Besides, when the fan equipment is placed in a narrow ventilator, the circulation of air may also be influenced and the size of impeller hubs is limited, and the narrow space also limits the application of an adjusting mechanism in a medium or small fan. For example, CN103727062A discloses "a device for adjusting moving blades of an axial flow fan", wherein the device is mainly composed of moving blades, transmission groups, impeller hubs, a hydraulic transmission system and a control panel, and the hydraulic system provides power in the blade adjusting process, so that the control panel drives the blades to change the installation angles. Such an adjusting structure increases the manufacturing and maintenance cost of the hydraulic system, is not suitable for being applied to a medium or small fan, and cannot realize synchronous adjustment.

In an existing mechanical adjusting type mechanism, e.g., "a device for adjusting moving blades of an axial flow fan" disclosed in CN204386932U, a motor drives a lead screw to rotate so that a nut produces axial displacement, and drives adjusting arms for blades so as to adjust the angles of the blades. The mechanism for adjusting blades is completely placed in a ventilator, thereby leading to the problems that the maintenance is inconvenient and the performance of the fan is influenced, and also failing to realize synchronous adjustment of two-stage blades.

For another example, CN201865932U discloses "an angle adjustable counter-rotating axial flow energy-saving fan for a mine", wherein a large bevel gear drives a series of small bevel gears to rotate so as to adjust the angles of blades, the synchronism of a plurality of moving blades would be poor in the adjusting process, and the moving blades are asynchronous during primary and secondary adjustment and need to be adjusted by shutdown, which is unbeneficial to the safety of the mine.

Therefore, it is particularly important to develop a two-stage blade adjusting mechanism for a counter-rotating axial flow fan, which is compact in structure and low in manufacturing cost and realizes synchronous adjustment.

SUMMARY

The present disclosure provides a two-stage blade adjusting device for a counter-rotating axial flow fan, which solves the problems of complex structure and poor synchronism of the existing mechanical adjusting mechanism for adjusting the angles of two-stage blades of a counter-rotating axial flow fan.

According to one aspect of the present disclosure, there is provided a two-stage blade adjusting device for a counter-rotating axial flow fan, including a transmission shaft, a primary impeller, a secondary impeller and an adjusting mechanism; wherein the adjusting mechanism is configured to drive a first bevel gear and a second bevel gear via a blade adjusting operation shaft and transfers power to a split sleeve of the transmission shaft, the split sleeve is configured to transform rotary motion of the first bevel gear and the second bevel gear into linear motion to lead to an axial displacement of an axial translation disc, a rotating angle pull rod is configured to push a first translation disc in a first impeller hub to move, and the first translation disc is configured to drive a first fan blade tumbler to rotate so as to adjust the blade installation angle of a first fan blade; the first translation disc in the first impeller hub transfers power to a second translation disc in a second impeller hub and a follow-up rotating rod via a bearing and a sleeve thereof, a second fan blade tumbler is configured to rotate to adjust the angle of a second fan blade on the second impeller hub, and synchronous adjustment of two-stage blade angles is thus realized.

In some embodiments, the first impeller hub and the second impeller hub are respectively fixed with the first translation disc and the second translation disc via the follow-up rotating rods, and springs are provided for keeping the axial positions of the first translation disc and the second translation disc.

In some embodiments, the blade adjusting operation shaft is a manual adjusting mechanism or an electric adjusting mechanism arranged outside the counter-rotating axial flow fan.

In some embodiments, the first bevel gear is fixed with the blade adjusting operation shaft via a bevel gear fixing shaft, a woodruff key and a key locking sleeve.

In some embodiments, the adjusting mechanism further includes a blade adjusting indication shaft with a blade rotation dial, and the blade adjusting indication shaft is engaged with the split sleeve and a blade adjusting angle center sleeve via a gear pair to transform the axial motion of the split sleeve into the rotation of the blade adjusting indication shaft, thereby displaying the two-stage blade adjusting angles of the fan.

Based on the above solution of the present disclosure, the adjusting device adopts a mechanical structure, a manual or electric rod and a bevel gear transmission mechanism thereof transform rotary motion into linear motion, leading to a axial displacement of the axial translation disc, and the two blade angles are simultaneously changed via the rotating angle pull rod, so that air quantity and air pressure are changed, the problem of high manufacturing and maintenance cost in the existing hydraulic driving mode is solved, and the problems of complex structure and poor synchronism when the two-stage blade angles of the counter-rotating axial flow fan are adjusted by adopting a mechanical adjusting mechanism are also solved. Meanwhile, the blade adjusting mechanism is arranged inside the impeller hubs, so that the structure of the adjusting mechanism is more compact, the ventilation resistance is further reduced, the consumption of energy is also reduced while the air pressure condition is satisfied, and counter-rotating impeller ventilation equipment achieves a good energy-saving effect.

Moreover, the adjusting mechanism is additionally provided with a blade adjusting indication shaft with a blade rotation dial, thereby adjusting and displaying any angle of two-stage blades of the counter-rotating axial flow fan and further enlarging the adjusting range of the blade angles. Besides, the blade adjusting operation shaft extends out of a ventilator, so that the adjustment of the blade angles is more convenient, flexible and reliable, and the application range of the counter-rotating axial flow fan is further widened.

BRIEF DESCRIPTION OF THE DRAWINGS

The drawings described herein are used for providing further understanding on the present disclosure and constitute a part of the present disclosure, and exemplary embodiments of the present disclosure and descriptions thereof are used for interpreting the present disclosure, but do not constitute improper limitation to the present disclosure. In which.

In which: 1: blade adjusting operation shaft; 2: first bevel gear; 3: second bevel gear; 4: split sleeve; 5: solid shaft; 6: axial translation disc; 7: first impeller hub; 8: first fan blade; 9: first fan blade tumbler; 10: first translation disc; 11: sleeve; 12: second translation disc; 13: second impeller hub; 14: hollow shaft; 15: follow-up rotating rod; 16: spring; 17: second fan blade tumbler; 18: second fan blade; 19: rotating angle pull rod; 20: key locking sleeve; 21: bevel gear rotating shaft lock nut; 22: first anti-rotating block; 23: blade adjusting angle center sleeve; 24: second anti-rotating block; 25: first C-shaped pressure block; 26: washer; 27: bolt; 28: blade rotation dial; 29: blade adjusting indication shaft; 30: retaining washer; 31: second C-shaped pressure block; 32: woodruff key; 33: bevel gear fixing shaft; 34: pin roll; 35: hand wheel.

DETAILED DESCRIPTION

The technical solution of the present disclosure will be further described in detail below via the drawings and embodiments.

Figure 1:
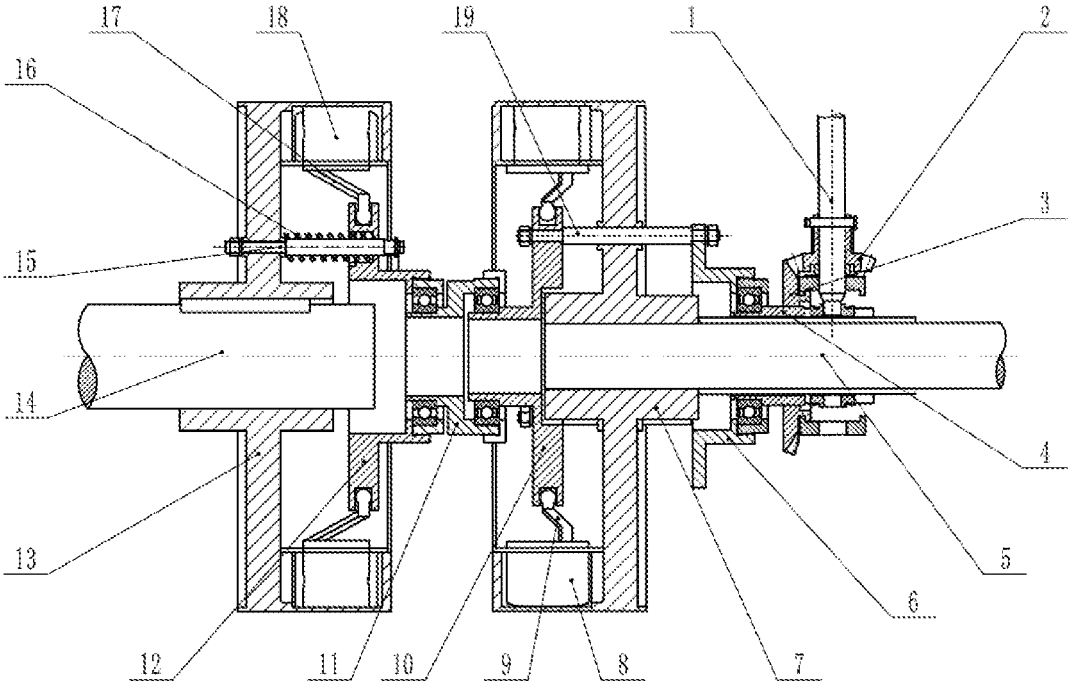
FIG. 1 is a structural schematic diagram of some embodiments of a two-stage blade adjusting device for a counter-rotating axial flow fan in the present disclosure.

FIG. 1 shows a structural schematic diagram of some embodiments of a two-stage blade adjusting device for a counter-rotating axial flow fan in the present disclosure. In present embodiments, the two-stage blade adjusting device is arranged coaxially, and a blade adjusting operation shaft 1 extends out of a ventilator to facilitate adjustment. In a specific structure, a first bevel gear 2 is fixed at the bottom of the blade adjusting operation shaft 1, and the first bevel gear 2 is engaged with a second bevel gear 3, and the second bevel gear 3 is engaged with a split sleeve 4, such that rotary rotation of the first bevel gear 2 and the second bevel gear 3 can be transformed into linear motion of the split sleeve 4, an axial translation disc 6 produces axial displacement, a rotating angle pull rod 19 pushes a first translation disc 10 in a first impeller hub 7 to move. The first translation disc 10 drives a first fan blade tumbler 9 to rotate so as to adjust the blade installation angle of a first fan blade 8. The first translation disc 10 in the first impeller hub 7 transfers power to a second translation disc 12 in a second impeller hub 13 and a follow-up rotating rod 15 via a bearing and a sleeve 11 thereof, a second fan blade tumbler 17 rotates to adjust the blade installation angle of a second fan blade 18 on the second impeller hub 13, thereby realizing the synchronous adjustment of two-stage blade angles.

In the above embodiments, the second impeller hub 13 is fixed with the second translation disc 12 via the follow-up rotating rod 15, and the first impeller hub 7 is also fixed with the first translation disc 10 via another follow-up rotating rod. By providing a spring 16, the positions of the first translation disc 10 and the second translation disc 12 in the axial direction can be kept, so that the synchronism of two-stage blade adjustment is guaranteed.

In the above embodiments, the blade adjusting operation shaft 1 is a manual adjusting mechanism or an electric adjusting mechanism arranged outside the counter-rotating axial flow fan. The blade adjusting operation shaft 1 can be fixed with the first bevel gear 2 via a bevel gear fixing shaft 33, a woodruff key 32 and a key locking sleeve 20.

Figure 2:
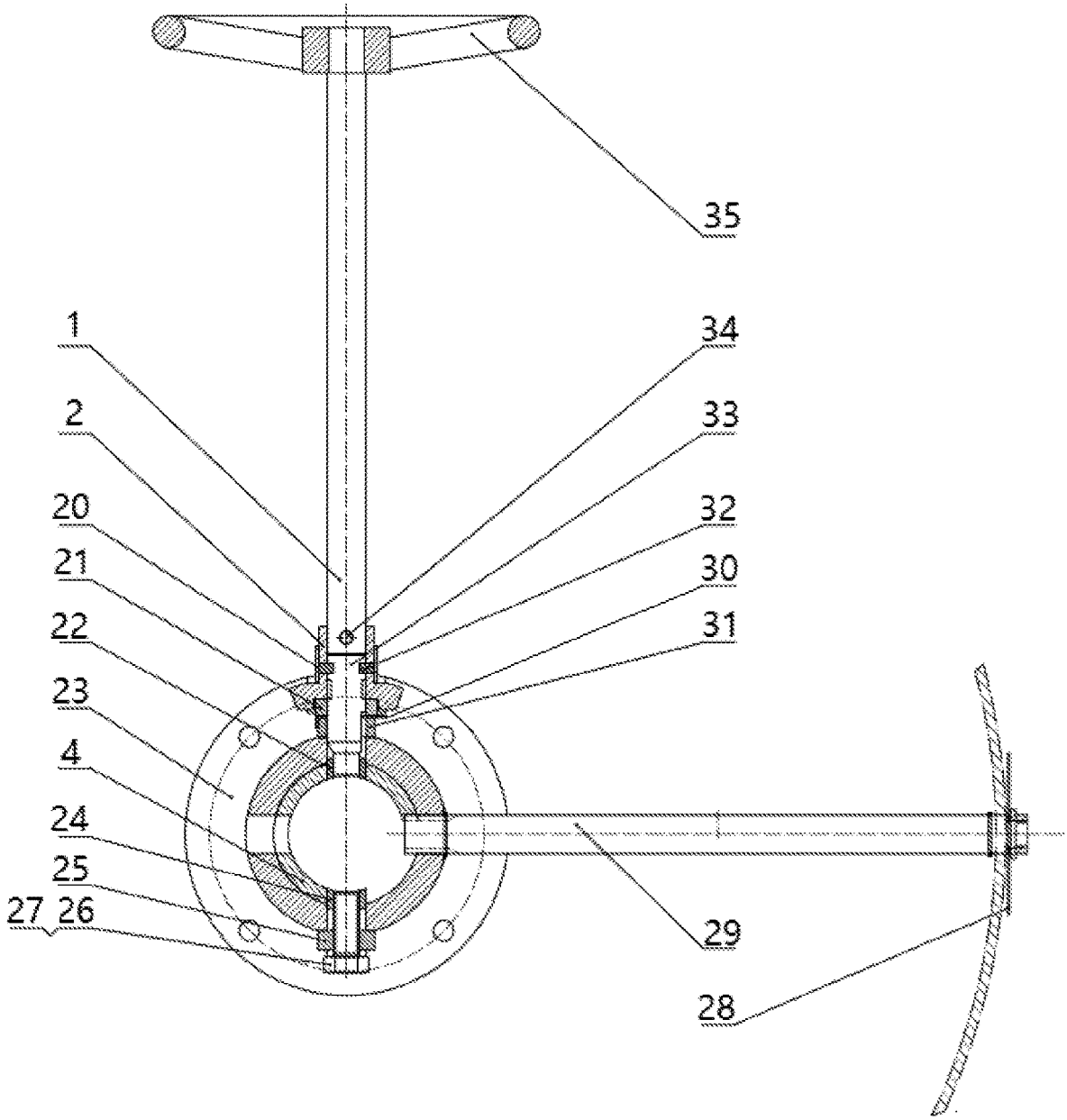
FIG. 2 is a schematic diagram of a blade angle display structure in other embodiments of the two-stage blade adjusting device for a counter-rotating axial flow fan in the present disclosure.
Figure 3:
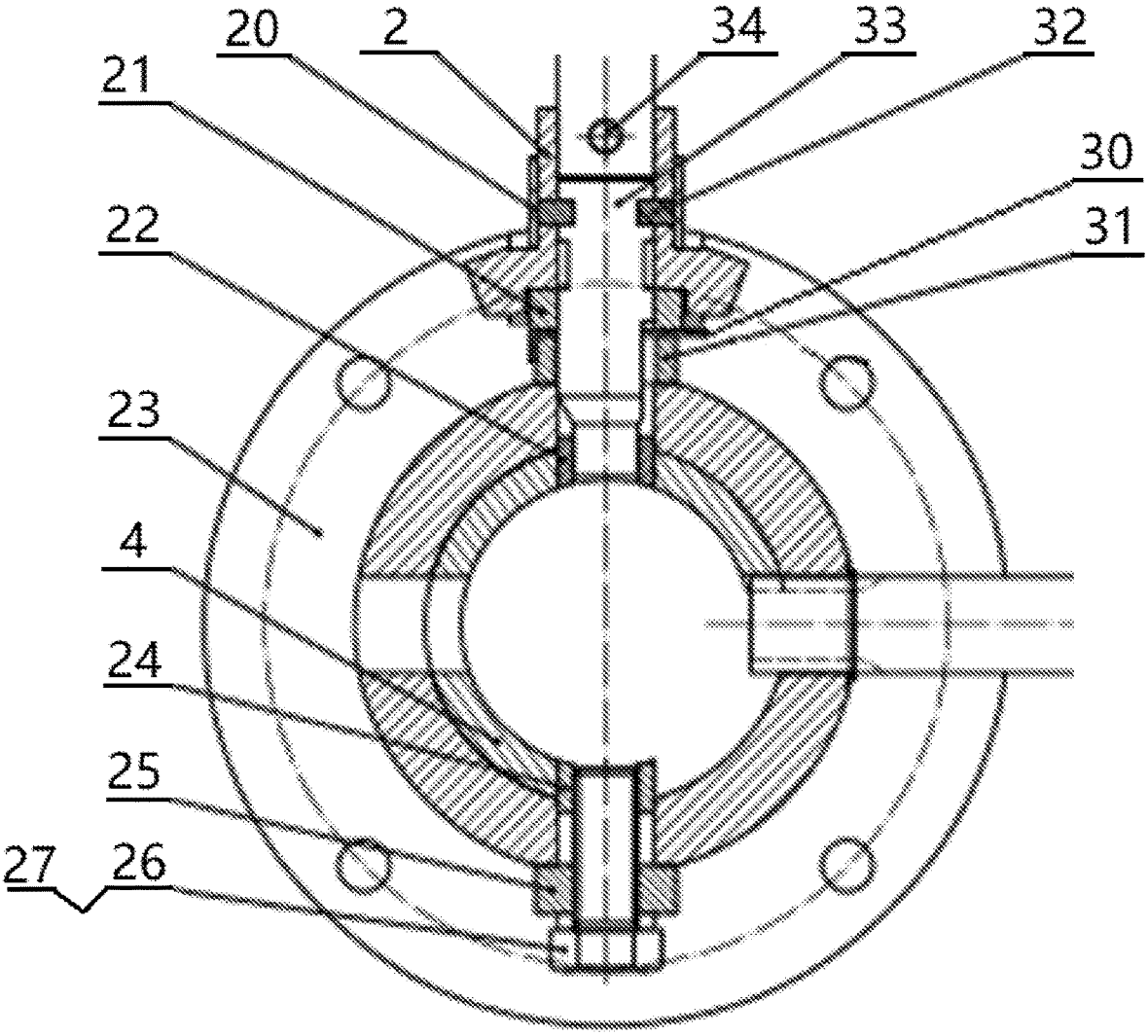
FIG. 3 is a zoom view of the core-sleeve region in FIG. 2.

In combination with FIG. 2 and FIG. 3, in the above embodiments, the adjusting mechanism in the two-stage blade adjusting device can further include a blade adjusting indication shaft 29 with a blade rotation dial 28, and the blade adjusting indication shaft 29 is engaged with the split sleeve 4 and a blade adjusting angle center sleeve 23 via a gear pair to transform the axial motion of the split sleeve 4 into the rotation of the blade adjusting indication shaft 29, thereby displaying the two-stage blade adjusting angles of the fan.

The adjusting structure in the above embodiments and the additional embodiments is simple, reliable and good in synchronism. Besides, the blade adjusting mechanism is arranged inside the impeller hubs, so that the ventilation resistance is reduced, and the structure is more compact. The blade adjusting operation shaft 1 is operated to extend out of the ventilator manually or electrically, so that the two-stage blade adjustment of the counter-rotating axial flow fan is more convenient, reliable and flexible, and any angle adjustment and synchronous adjustment of two-stage blade installation angles are simultaneously realized. The device is simple and compact in structure and low in manufacturing and maintenance cost, and would be widely applied to large, medium and small counter-rotating axial flow fans.

Finally, it should be noted that the above embodiments are merely used for describing the technical solution of the present disclosure, rather than limiting the present disclosure; though the present disclosure is described in detail with reference to preferred embodiments, it should be understood by those of ordinary skill in the art that modifications still can be made to the specific embodiments of the present disclosure or equivalent replacements can be made to part of the technical features; and these modifications or equivalent replacements without departing from the spirit of the technical solution of the present disclosure shall fall into the protection scope of the technical solution of the present disclosure.

The invention claimed is:

1. A two-stage blade adjusting device for a counter-rotating axial flow fan, comprising a transmission shaft, a primary impeller, a secondary impeller and an adjusting mechanism;

wherein the adjusting mechanism is configured to drive a first bevel gear and a second bevel gear via a blade adjusting operation shaft and transmit power to a split sleeve of the transmission shaft; the split sleeve is configured to transform rotary motion of the first bevel gear and the second bevel gear into linear motion, such that an axial translation disc produces axial displacement; and a rotating angle pull rod is configured to push a first translation disc in a first impeller hub to move; the first translation disc is configured to drive a first fan blade tumbler to rotate so as to adjust a blade installation angle of a first fan blade; the first translation disc in the first impeller hub is configured to transfer power to a second translation disc in a second impeller hub and a follow-up rotating rod via a bearing and a sleeve of the bearing; a second fan blade tumbler is configured to rotate to adjust a blade installation angle of a second fan blade on the second impeller hub, such that synchronous adjustment of two-stage blade angles is thus realized.

2. The two-stage blade adjusting device for the counter-rotating axial flow fan according to claim 1, wherein the first impeller hub is fixed with the first translation disc via the follow-up rotating rod and the second impeller hub is fixed with the second translation disc via another follow-up rotating rod, and a spring is provided for keeping positions of the first translation disc and the second translation disc in an axial direction.

3. The two-stage blade adjusting device for the counter-rotating axial flow fan according to claim 1, wherein the blade adjusting operation shaft is a manual adjusting mechanism or an electric adjusting mechanism, arranged outside the counter-rotating axial flow fan.

4. The two-stage blade adjusting device for the counter-rotating axial flow fan according to claim 1, wherein the first bevel gear is fixed with the blade adjusting operation shaft via a bevel gear fixing shaft, a woodruff key, and a key locking sleeve.

5. The two-stage blade adjusting device for the counter-rotating axial flow fan according to claim 1, wherein the adjusting mechanism further comprises a blade adjusting indication shaft with a blade rotation dial, and the blade adjusting indication shaft is engaged with the split sleeve and a blade adjusting angle center sleeve via a gear pair.

* * * * *